US011124727B2

(12) United States Patent
Cuthbert et al.

(10) Patent No.: US 11,124,727 B2
(45) Date of Patent: Sep. 21, 2021

(54) LOW VOC LUBRICANT COMPOSITIONS

(71) Applicant: Dow Global Technologies LLC, Midland, MI (US)

(72) Inventors: John B. Cuthbert, Midland, MI (US); Felipe A. Donate, Midland, MI (US); Matthew W. Entorf, Midland, MI (US); Ashish Kotnis, Auburn Hills, MI (US); Ellen D. Hock, Midland, MI (US); Lindsey A. Clark, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 49 days.

(21) Appl. No.: 16/621,791

(22) PCT Filed: Jun. 26, 2018

(86) PCT No.: PCT/US2018/039392
§ 371 (c)(1),
(2) Date: Dec. 12, 2019

(87) PCT Pub. No.: WO2019/005723
PCT Pub. Date: Jan. 3, 2019

(65) Prior Publication Data

US 2020/0172823 A1 Jun. 4, 2020

Related U.S. Application Data

(60) Provisional application No. 62/526,033, filed on Jun. 28, 2017.

(51) Int. Cl.

| | |
|---|---|
| ***C10M 105/36*** | (2006.01) |
| *C10N 30/02* | (2006.01) |
| *C10N 30/10* | (2006.01) |

(52) U.S. Cl.
CPC .. *C10M 105/36* (2013.01); *C10M 2207/2835* (2013.01); *C10N 2030/02* (2013.01); *C10N 2030/10* (2013.01)

(58) Field of Classification Search
CPC ..... C10M 105/36; C10M 2207/2835; C10N 2030/02; C10N 2030/10; C10N 2030/74; C10N 2060/06
See application file for complete search history.

(56) References Cited

U.S. PATENT DOCUMENTS

| | | | | |
|---|---|---|---|---|
| 3,218,256 | A | 11/1965 | Edwards et al. | |
| 3,296,138 | A | 1/1967 | Cupper et al. | |
| 3,567,636 | A | 3/1971 | Katzenstein | |
| 4,596,664 | A | 6/1986 | Fifolt et al. | |
| 7,763,337 | B2 | 7/2010 | Paiva et al. | |
| 8,153,569 | B2 | 4/2012 | Kuratomi et al. | |
| 9,228,147 | B2 | 1/2016 | Patil et al. | |
| 2009/0105103 | A1 | 4/2009 | Hashida et al. | |
| 2009/0186787 | A1 | 7/2009 | Scherer et al. | |
| 2012/0025824 | A1 | 2/2012 | Harder et al. | |
| 2012/0258249 | A1 | 10/2012 | Adamson et al. | |
| 2015/0322372 | A1* | 11/2015 | Gao | C10M 105/36 508/409 |
| 2016/0333223 | A1 | 11/2016 | Qie et al. | |

FOREIGN PATENT DOCUMENTS

| | | |
|---|---|---|
| EP | 0939115 | 9/1999 |
| WO | 2014179723 | 11/2014 |
| WO | 2015200088 | 12/2015 |

OTHER PUBLICATIONS

International Search Report & Written Opinion for related PCT Application PCT/US2018/039392, dated Aug. 24, 2018 (13 pgs).
Sadykhov, et al., "Synthesis and Study of Properties of Mixed Easters of Oxypropylated Octyl Alcohol and Dicarboxylic Acids", Chemical Abstracts Service, Columbus, Ohio, US (1988) (Machine Translation & Original Document; total: 6 pgs).
International Preliminary Report on Patentability for related PCT Application PCT/US2018/039392, dated Jan. 9, 2020 (7 pgs).

* cited by examiner

*Primary Examiner* — Ellen M McAvoy
*Assistant Examiner* — Chantel L Graham
(74) *Attorney, Agent, or Firm* — Brooks, Cameron & Huebsch, PLLC

(57) ABSTRACT

Certain glycol ether diesters have improved lubrication properties.

10 Claims, No Drawings

LOW VOC LUBRICANT COMPOSITIONS

This application is a National Stage Application under 35 U.S.C. § 371 of International Application Number PCT/US2018/039392, filed Jun. 26, 2018 and published as WO 2019/005723 on Jan. 3, 2019, which claims the benefit to U.S. Provisional Application 62/526,033, filed Jun. 28, 2017, the entire contents of which are incorporated herein by reference in its entirety

FIELD

The disclosure relates to compounds that are useful in the preparation of lubricants. More specifically, the disclosure relates to compounds that are useful in the preparation of synthetic lubricants.

BACKGROUND

Lubricants are used to reduce friction between moving surfaces by forming a fluid layer or film between them. Lubricants are generally composed of a base stock or mixture of base stocks that form the bulk of the fluid, and one or more additives. Lubricant rheology is determined primarily by the base stocks. Base stock viscosity is a key property in determining the thickness of the formed layers or films. If the viscosity of the base stock is too low, then the films will be too thin; as a result, the moving surfaces will come into contact and damage to them in the form of wear will occur. If the base stock viscosity is too high, then the films will be excessively thick and wear will be prevented or reduced, but the increased friction will result in excessive energy consumption. Thus, choosing a base stock with the appropriate viscosity for the application is critical to protecting a machine and optimizing energy consumption.

A change in temperature results in a dramatic change in base stock viscosity. For example, it is not unusual to see viscosity change by an order of magnitude or more as a result of a change in temperature of 50° C. It would be desirable to have a lubricant that exhibits a minimal change in viscosity with a change in temperature in order to maintain good lubrication and energy efficiency at operating temperatures or at conditions other than the design conditions of the machine, e.g. at start-up, lower or higher loads, and/or lower or higher operating temperatures. Temperature change with viscosity can be characterized by one number, the viscosity index or VI. The higher the VI, the less change the viscosity will undergo with a given change in temperature. It is therefore desirable to have lubricants with very high VI values. Finally, lubricants with low viscosity at lower temperatures are desirable for operational flexibility. If a lubricant is to be used in an environment where equipment is exposed to ambient temperatures of less than 0° C. and the lubricant viscosity is excessive, it may not be possible to operate the machine or damage may occur if the machine is operated in the case of reduced lubricant flow caused by high lubricant viscosity.

Some base stocks used to formulate lubricants can interact with surfaces to form tribo-layers that also reduce friction and provide anti-wear protection, especially in mixed or elasto-hydrodynamic lubrication regimes. Base stocks that are more polar in nature, such as esters and polyalkylene glycols (PAGs), are known to be more surface active and will preferentially interact with surfaces reducing friction and improving anti-wear performance. This is the case whether they are used as a primary base stock or used in combination with base stocks, such as those of API Groups I-V, in a lubricant formulation. In addition, polar compounds such as esters or PAGs can act synergistically with extreme pressure (EP)/anti-wear (AW) additives to improve the performance of the additives by facilitating their transport to wear surfaces.

Base stocks used in lubricants should also have low volatility at operating conditions, good seal compatibility, low toxicity, good biodegradability, hydrolytic stability and high thermal and oxidative stability. U.S. Pat. No. 3,218,256 discloses synthetic lubricants comprising organic carboxylic esters, such as dibutoxyethoxyethyl adipate, (DBEEA), which is also called bis(diethylene glycol monobutyl ether) adipate, and which is a diester prepared from an ethylene oxide-based glycol ether. Unfortunately, DBEEA lacks sufficient hydrolytic stability, is too volatile, and has poor solubility in API Groups I-IV base stocks.

It would be desirable to have an improved lubricant base stock compared to DBEEA.

SUMMARY

The composition of this disclosure is such an improved lubricant composition comprising: (A) a base stock comprising a glycol ether diester compound of the Formula I:

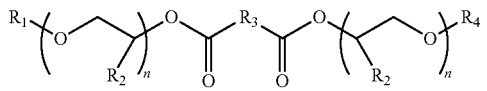

wherein $R_3$ is a straight or branched alkylene chain containing 0 to 4 carbon atoms, each $R_1$ and $R_4$ is independently a $C_1$ to $C_{13}$ straight or branched alkyl, phenyl, benzyl, or alkylated phenyl moiety, each $R_2$ is independently methyl or ethyl or a combination thereof, and each n independently has an average value of from 2 to 4, with the proviso that the total number of carbon atoms in the each moiety $R_1$—(O—$CH_2CHR_2$)n and $R_4$—(O—$CH_2CHR_2$)n is at least 10; and (B) an effective amount of an antioxidant.

Bis-dipropylene glycol n-butyl ether adipate and other compounds of Formula I described in this disclosure may provide improved lubricant properties compared to DBEEA. For example, compounds of the disclosure may have surprisingly improved properties, such as, for example, hydrolytic stability, lower volatility, and better solubility in Group I-IV base stocks, compared to DBEEA.

DETAILED DESCRIPTION

This disclosure involves a lubricant composition comprising: (A) a glycol ether diester compound of the Formula I, and (B) an antioxidant.

As used herein, the terms "a," "an," "the," "at least one," and "one or more" are used interchangeably. The terms "comprises" and "includes" and variations thereof do not have a limiting meaning where these terms appear in the description and claims. Thus, for example, "a" material can be interpreted to mean "one or more" materials, and a composition that "includes" or "comprises" a material can be interpreted to mean that the composition includes things in addition to the material.

Unless stated to the contrary, implicit from the context, or customary in the art, all parts and percentages are based on weight and all test methods are current as of the filing date of this disclosure.

As used herein, the term "an effective amount of an antioxidant" means an amount that, during the use of the composition, is sufficient to provide antioxidant properties or functionality to the composition in which the antioxidant is employed.

This disclosure involves a lubricant composition comprising a glycol ether diester compound of the Formula I:

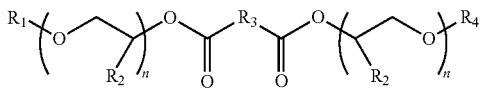

wherein $R_3$ is a straight or branched alkylene chain containing 0 to 4 carbon atoms each $R_1$ and $R_4$ is independently a $C_1$ to $C_{13}$ straight or branched alkyl, phenyl, benzyl, or alkylated phenyl moiety, each $R_2$ is independently methyl or ethyl or a combination thereof, each n independently has an average value of 2 to 4 with the proviso that the total number of carbon atoms in the each moiety $R_1$—(O—$CH_2CHR_2$)n and $R_4$—(O—$CH_2CHR_2$)n is at least 10. When $R_3$ is 0, it is simply a bond between the carbonyl moieties shown in Formula I. In one embodiment, $R_3$ is a straight or branched alkylene chain containing 1 to 4 carbon atoms. The value of n can be an integer but in some cases is not an integer, depending on the amount of alkylene oxide used in the preparation of the intermediates used in the preparation of the compound of Formula I. A combination of methyl and ethyl moieties occurs for $R_2$ when a mixture of propylene oxide and butylene oxide is employed in the preparation of the intermediates used in the preparation of the compound of the Formula I. Examples of compounds included in the preceding Formula I include bis-dipropylene glycol n-butyl ether adipate (DPnB adipate, also called dibutoxypropoxypropyl adipate), bis-tripropylene glycol n-butyl ether succinate, bis-dipropylene glycol n-hexyl ether adipate, and bis-butoxy(methylethoxy)(ethylethoxy) adipate, bis-butoxy (ethylethoxy)(ethylethoxy) adipate, and bis-dodecyloxy (ethylethoxy)(ethylethoxy) adipate. DPnB adipate is available from The Dow Chemical Company under the tradename DOWANOL™ LoV 485.

In one embodiment, the compound of Formula I has less than 1% volatiles, or less than 0.5% volatiles, as measured by ASTM D2369. In one embodiment, the compound of Formula I has a hydrolytic stability of less than 50, or less than 20, or less than 15 mgKOH/g as measured according to the method of ASTM D2619. In one embodiment, the compound of Formula I has a VOC content of less than 1, or less than 0.8, or less than 0.6, or less than 0.4, or less than 0.3 wt. % as measured according to the method of ASTM D2396.

Methods for the preparation of the compounds of Formula I are well-known to those skilled in the art. See, e.g. WO2015/200088A1, US2012/0258249A1 and U.S. Pat. No. 8,906,991. Generally speaking, one method of preparation involves reacting a dicarboxylic acid with a hydroxyl-containing reactant, optionally in the presence of an alkaline catalyst. Examples of dicarboxylic acid reactants include, for example, oxalic acid, malonic acid, succinic acid and adipic acid. Examples of useful hydroxyl-containing reactants include glycol ether reactants such as, for example, dipropylene glycol 2-ethylhexyl ether, dipropylene glycol phenyl ether, tripropylene glycol n-pentyl ether, dipropylene glycol methyl ether, tripropylene glycol methyl ether, dipropylene glycol n-butyl ether, dipropylene glycol n-propyl ether, tripropylene glycol n-propyl ether, propylene glycol n-butyl ether, tripropylene glycol n-butyl ether, dibutylene glycol n-butyl ether, dibutylene glycol n-dodecyl ether and propylene glycol methyl ether.

The lubricant composition may use a compound of Formula I as the sole base stock or it may be formulated to include other base stocks in addition to the compound of the present disclosure. For example, a base stock composition may comprise from 1 to 50 weight parts of the compound of Formula I in combination with from 99 to 50 weight parts of another API Group I, II, III, IV or V base stock, wherein the total base stock comprises 100 weight parts of base stock compound(s). In addition, a base stock composition may comprise from 1 to 30 weight parts of the compound of Formula I in combination with from 99 to 70 weight parts of another API Group I, II, III, IV or V base stock, wherein the total base stock comprises 100 weight parts of base stock compound(s). In one embodiment, a base stock composition may comprise from 1 to 15 weight parts of the compound of Formula I in combination with from 99 to 85 weight parts of another API Group I, II, III, IV or V base stock, wherein the total base stock comprises 100 weight parts of base stock compound(s). API Group I, II, III, IV and V base stocks are defined by the American Petroleum Institute. Examples API Group V base stocks include: polyalkylene glycols such as base stocks sold under the UCON™ and SYNALOX™ tradenames; di-, tri- and polyol esters; seed oil derived triglycerides; trimethylsiloxanes; and alkylated naphthalenes and alkylated benzenes. Mixtures of additional base stocks may be employed, and many base stocks are commercially available.

In various embodiments, the base stock of the disclosure may include the compound of Formula I in minimum amounts of at least 1 weight part, at least 5 weight parts, at least 10 weight parts, at least 20 weight parts or 100 weight parts based on 100 parts base stock. In various embodiments, the base stock of the disclosure may include the compound of Formula I in maximum amounts of at most 100 weight parts, at most 99 weight parts, at most 95 weight parts, at most 90 weight parts, or at most 80 weight parts based on 100 parts base stock.

The composition of the disclosure comprises an effective amount of an antioxidant. Antioxidants include, for example, phenolic antioxidants, hindered phenolic antioxidants, sulfurized phenolic antioxidants, sulfurized olefins, and the like. Examples of antioxidants include: phenolic or aromatic amines, butylated hydroxytoluene (BHT), alkylated diphenylamine, phenyl-α-naphthylamine (PANA), 2,2'-methylene bis (4-methyl-6-tert-butylphenol), C7-C9 branched alkyl esters of 3,5-bis(1,1-dimethylethyl)-4-hydroxy benzenepropanoic acid, 4,6-bis (octylthiomethyl)-o-cresol, tetrakismethylene (3,5-di-t-butyl-4-hydroxyhydrocinnamate)methane, and alkylated phenyl-α-naphthylamine. Antioxidants for use in lubricant compositions are well-known and many are commercially available. Typical antioxidant concentrations in the composition of the disclosure range from 0.05 or 0.1 weight parts to 4 or 5 weight parts, based on 100 weight parts base stock.

In one embodiment, the composition of the disclosure may be employed as a concentrate for blending with another base stock. In such a case, the antioxidant concentration may be higher than the desired concentration for final use, and in such a case the amount of antioxidant may be from 0.1 to 15, or 2 to 10, weight parts, based on 100 weight parts base stock.

The lubricant composition may be formulated to include conventional additives such as, for example: oil-soluble copper compounds, aromatic amine antioxidants, secondary amine antioxidants, and mixtures thereof), extreme pressure/antiwear (EP/AW) additives, and rust and corrosion inhibitors including, as examples, copper corrosion inhibitors, yellow metal corrosion inhibitors and/or ferrous corrosion inhibitors. Other additives depending on the desired application may include defoamers or anti-foams such as polymethylsiloxanes, pour point depressants, dyes, metal deactivators, viscosity index improvers (e.g. olefin copolymers, polymethacrylates), detergents such as calcium or magnesium overbased detergents, demulsifiers, dispersants (e.g. polyisobutylene succinic anhydride), friction modifiers (e.g. molybdenum dithiocarbamate, glycerol mono-oleate, UCON™ OSP fluids), supplemental friction modifiers, and/or diluents, and the like. The amount of additives may be from 0 to 15 weight parts, based on 100 weight parts of the base stock of the lubricant composition. For example, in a lubricant composition having 100 weight parts base stock, 0 to 15 weight parts of additives may be present. In one embodiment of the disclosure, the amount of additives is from 100 parts per million by weight ("ppmw') of the lubricant composition to 2 weight parts, based on 100 weight parts base stock. Many additives are well-known to those skilled in the art and are commercially available.

Examples of extreme pressure/antiwear (EP/AW) additives include alkyl- and aryl phosphate esters including mono-, di- and tri-phosphate esters and the amine salts of mono- and di-ester phosphates. DURAD 310M is an example an aryl phosphate ester, IRGALUBE 349 an example of an amine phosphate. Esters of phosphorothionate such as IRGALUBE TPPT are also useful. Sulfurized olefins, esters, and fats are useful extreme pressure additives. Chlorinated paraffins and fatty acids can be used to provide EP properties. Zinc dialkyldithiophosphates (ZDDP) are also useful for anti-wear and as secondary antioxidants. EP/AW additives for use in lubricant compositions are well-known and many are commercial available.

Examples of yellow metal corrosion inhibitors include tolutriazole and 1H-Benzotriazole-1-methanamine, N,N-bis (2-ethylhexyl)-ar-methyl-(IRGAMET 39), benzotriazole and mercaptobenzothiazole. Examples of sulfur scavengers include dimercaptothiadiazole derivatives (King Industries K-CORR NF 410).

Examples of ferrous corrosion inhibitors include calcium alkylnaphthalenesulfonate/carboxylate complex (Na Sul Ca 1089 from King Industries), carbonated basic barium dinonylnaphthalenesulfonate (Na Sul 611), and amine salts of aliphatic phosphoric acid esters (Na-Lube AW 6110).

In one embodiment, the lubricant composition of the disclosure is substantially free of filler. In one embodiment, the composition of this disclosure may include a filler and/or a thickener.

SPECIFIC EMBODIMENTS

Materials

DOWANOL LoV 485 is a bis-dipropylene glycol n-butyl ether adipate (DPnB adipate) and is commercially available from The Dow Chemical Company.

DBEEA is a dibutoxyethoxyethyl adipate (DBEEA) and is commercially available from Sigma-Aldrich.

PAO: polyalphaolefin, an API Group IV base stock. The number, e.g. "10," refers to the nominal 100° C. kinematic viscosity. The PAO in these examples are ExxonMobil SPECTRASYN polyalphaolefin base stocks.

YUBASE: YUBASE is the trade name for API Group III base stocks produced by SK Lubricants of South Korea. The number, e.g. "4", refers to the nominal 100° C. kinematic viscosity.

ULTRA-S: ULTRA-S is the trade name for API Group III base stocks produced by S-Oil of South Korea. The number, e.g. "3", refers to the nominal 100° C. kinematic viscosity.

PURE PERFORMANCE: These are API Group II base stocks produced by Phillips 66. The number, e.g. "110" is the nominal kinematic viscosity in Saybolt Universal Seconds (SUS) at 100° F. The 110 and 225 oils have approximately the same 100° C. kinematic viscosities as the YUBASE and ULTRA-S oils. The 660 oil has a 100° C. viscosity between PAO 40 and PAO 100.

EXAMPLE 1

Various glycol ether diesters are evaluated as lubricant base stocks. The test methods employed are as follows. The viscometric properties of DPnB adipate and DBEEA are determined by several methods, to wit: kinematic viscosities at 40° C. and 100° C. by use of a Stabinger viscometer following ASTM D 7042; Viscosity Index is calculated from the kinematic viscosity data following ASTM D2770; pour points are measured following ASTM D97; and −30° C. viscosities are measured with a Brookfield DV-III viscometer using the small sample adaptor. The results are shown in Table 1.

TABLE 1

Comparison of Viscometric Properties

| | Viscosity, $mm^2/s$ ASTM D7042 | | Viscosity Index, ASTM | Brookfield viscosity, mPa s | Pour Point, ° C. ASTM |
|---|---|---|---|---|---|
| | 40° C. | 100° C. | D2770 | −30° C. | D97 |
| DPnB adipate | 12.3 | 3.3 | 139 | 864 | <−60 |
| DBEEA | 11.4 | 3.2 | 156 | 764 | — |

As can be seen from Table 1, the viscometric properties of DPnB adipate and DBEEA are roughly equivalent.

The viscometric properties of various base stocks from API Groups II-IV are summarized in Table 2.

TABLE 2

Viscometric Properties of Select API Group II, III and IV base stocks

| Base stock | 100° C. viscosity $mm^2/s$ | Viscosity Index | Pour point, ° C. |
|---|---|---|---|
| Pure Performance 80N | 3.1 | 76 | −27 |
| Ultra S 3 | 3.3 | 116 | −25 |
| PAO 4 | 4.1 | 126 | −66 |

All Data from supplier literature

Comparing Table 1 to Table 2 shows that, when DPnB adipate and DBEEA are compared to the viscometric properties of API Groups II, III or IV base stocks with similar 100° C. kinematic viscosities of approximately 3 $mm^2/s$, a clear advantage can be seen. Comparing Table 1 to Table 2 shows that DPnB adipate and DBEEA have higher Viscosity Indices than all three API Group II, III and IV base stocks and yet have pour points lower than the Group II and III base stocks.

EXAMPLE 2

Select physical properties of DPnB adipate and DBEEA are measured. Volatile organic carbon content (VOC) is measured according to ASTM D 2396. Hydrolytic stability is measured on each compound on an "as received" basis according to ASTM D2619. 4-ball wear measurements are made on each fluid according to ASTM D4172 at the following conditions: applied load of 40 kgf at 1200 rpm and 75° C. for 1 hr. Results from the testing are summarized in Table 3.

TABLE 3

Comparison of Physical Properties

| | VOC content, wt. % ASTM D2396 | Hydrolytic stability[1], mgKOH/g ASTM D2619 | 4-ball wear, mm ASTM D 4172 |
|---|---|---|---|
| DPnB adipate | 0.2 | 12.4 | 1.26 |
| DBEEA | 2.9 | 260.9 | 1.00 |

[1]Total acidity of water layer

As can be seen from Table 3, the DPnB adipate and DBEEA have approximately the same kinematic viscosity at 100° C. at approximately 3.3 mm/s2. However, the volatility of the DBEEA is an order of magnitude higher, suggesting that volatile losses of DBEEA in use will be much greater than those of DPnB adipate, requiring more lubricant replenishment over time.

Hydrolysis of ester based lubricants while in use can shorten the service life of the lubricant, requiring frequent lubricant replacement. Damage to equipment can occur if timely action is not taken to replace lubricant that has undergone hydrolysis. Both DPnB adipate and DBEEA are diesters of adipic acid, yet, as shown in Table 3, DPnB adipate undergoes much less hydrolysis than the DBEEA as measured by the acidity of the water layer. This data indicates that lubricants formulated with DPnB adipate will be much more resistant to hydrolysis than similar lubricants formulated with DBEEA.

EXAMPLE 3

Solutions of DPnB adipate or DBEEA with Groups II, III or IV base stocks are prepared by weighing a predetermined amount of Groups II, III or IV base stock into a container followed by the addition of a predetermined amount of DPnB adipate or DBEEA. A magnetic stirrer is used to mix the solutions and is turned on after the addition of the base stock. Initial mixing of the solution is done at room temperature. If the DPnB adipate or DBEEA dissolves readily in the base stock, no additional heat is applied. If the DPnB adipate or DBEEA does not readily dissolve, the solution is heated to 55° C. and is mixed until a clear solution is obtained. If a clear solution is not obtained, the DPnB adipate or DBEEA is determined to be insoluble in the base stock at that concentration.

Clear solutions of DPnB adipate or DBEEA and Groups II, III or IV base stocks are allowed to sit undisturbed for eight weeks at room temperature. At the end of eight weeks, each solution is examined for clarity. If the solution is not clear or is observed to have multiple liquid phases, the particular concentration of DPnB adipate or DBEEA in Groups II, III or IV base stocks is determined to be insoluble.

Use of this procedure determines the solubility of DPnB adipate or DBEEA in Groups II, III or IV base stocks. The results are summarized in Table 4.

TABLE 4

Comparison of Base Stock Solubility

| | Weight % Solubility at 25° C. | |
|---|---|---|
| Test Fluid | DPnB adipate | DBEEA |
| PAO 10 | 10 | 1 |
| PAO 40 | 5 | 1 |
| PAO 100 | 7 | 1 |
| Ultra S 3 | 10 | 2 |
| YUBASE 4 | 10 | 2 |
| YUBASE 8 | 10 | 1 |
| PURE PERFORMANCE 110N | 10 | 1 |
| PURE PERFORMANCE 225N | 10 | 1 |
| PURE PERFORMANCE 600N | 10 | 1 |

The solubility data shows that DPnB adipate is far more soluble than DBEEA in Groups II, III or IV base stocks.

DPnB adipate and DBEEA are diesters of adipic acid with 100° C. kinematic viscosities of approximately 3.3 mm/s$^2$. The viscometrics of both compounds are very similar and are superior to those of API Groups I, II, III and IV with similar 100° C. kinematic viscosities. Surprisingly, compared to DBEEA, DPnB adipate has much lower volatility, better hydrolytic stability and greater solubility in Groups I, II, III and IV base oils.

What is claimed is:

1. A lubricant composition comprising: (A) a base stock comprising a glycol ether diester compound of Formula I:

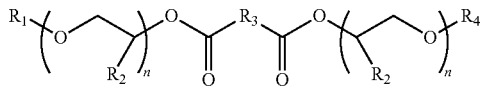

wherein $R_3$ is a straight or branched alkylene chain containing 0 to 4 carbon atoms, each $R_1$ and $R_4$ is independently a $C_1$ to $C_{13}$ straight or branched alkyl, phenyl, benzyl, or alkylated phenyl moiety, each $R_2$ is independently methyl or ethyl or a combination thereof, and each n independently has an average value of from 2 to 4 with the proviso that the total number of carbon atoms in the each moiety $R_1$—(O—$CH_2CHR_2$)n and $R_4$—(O—$CH_2$ $CHR_2$)n is at least 10; and (B) an effective amount of an antioxidant.

2. The composition of claim 1 wherein each $R_1$ and $R_4$ is independently a C1 to C13 straight chain alkyl moiety, and $R_3$ is a straight chain alkylene chain containing 0 to 4 carbon atoms, or 1 to 4 carbon atoms.

3. The composition of claim 1 wherein R1 and R4 are the same.

4. The composition of claim 1 wherein each $R_2$ is methyl, or wherein each $R_2$ is ethyl.

5. The composition of claim 1 wherein composition comprises at least 20 weight parts of the compound of Formula I and from 0.05 to 5 weight parts of the antioxidant.

6. The composition of claim 1 wherein the base stock further comprises at least one base stock from API Groups I, II, III, IV and V.

7. The composition of claim 1 wherein the base stock comprises from 1 to 50 weight parts of the compound of Formula I and from 99 to 50 weight parts of at least one base stock from API Groups I, II, III, IV and V, based on 100 weight parts base stock, or the base stock comprises from 1 to 30 weight parts of the compound of Formula I and from 99 to 70 weight parts of another API Group V base stock.

8. The composition of claim 1 wherein the base stock comprises at least one base stock of API Groups I, II, II and IV having a 100° C. kinematic viscosity between 3 and 5 cSt.

9. The composition of claim 1 wherein the composition comprises at least 20 weight parts of the compound and from 0.05 to 5 weight parts of the antioxidant.

10. The composition of claim 1 wherein the compound is at least one of bis-dipropylene glycol n-butyl ether adipate, bis-tripropylene glycol n-butyl ether succinate, bis-dipropylene glycol n-hexyl ether adipate, or bis-butoxy(methylethoxy)(ethylethoxy) adipate.

* * * * *